US005163221A

United States Patent [19]

Favre-Tissot et al.

[11] Patent Number: 5,163,221

[45] Date of Patent: Nov. 17, 1992

[54] METHOD OF WELDING A FLEXIBLE CONDUCTOR TO A CONTACT FINGER

[75] Inventors: Jean-Paul Favre-Tissot, Brignoud; Georges Fevrier, Vizille, both of France

[73] Assignee: Merlin Gerin, France

[21] Appl. No.: 727,093

[22] Filed: Jul. 9, 1991

[30] Foreign Application Priority Data

Jul. 19, 1990 [FR] France ..... 90 09359

[51] Int. Cl.[5] ..... H01R 43/02

[52] U.S. Cl. ..... 29/860; 29/863; 174/94 R; 219/91.2; 219/117.1

[58] Field of Search ..... 29/857, 860, 863; 219/91.2, 117.1; 174/94 R

[56] References Cited

U.S. PATENT DOCUMENTS

| | | | |
|---|---|---|---|
| 3,648,014 | 3/1972 | Bennett | 174/94 R X |
| 4,315,175 | 2/1982 | Hamilton et al. | 29/860 X |
| 4,317,277 | 3/1982 | Bennett et al. | 29/860 |
| 4,583,065 | 4/1986 | Favre-Tissot . | |

FOREIGN PATENT DOCUMENTS

| | | | |
|---|---|---|---|
| 258377 | 11/1967 | Austria | 174/94 R |
| 0148051 | 7/1985 | European Pat. Off. . | |
| 0297985 | 1/1989 | European Pat. Off. . | |

*Primary Examiner*—Carl J. Arbes

*Attorney, Agent, or Firm*—Parkhurst, Wendel & Rossi

[57] ABSTRACT

A connection process by welding a braided strip to a contact finger defined by side by side stacking of two elementary blades. The first blade is provided with a semi-open notch cooperating with the juxtaposed flat face of the second blade to define a housing receiving a compacted end of the braided strip, said end being hot encrusted in the housing by welding under pressure, without local deformation of the blades. The second blade comprises an overspill aperture located facing the notch to enable the molten copper from the compacted end to be transferred during the welding operation, the surface of the aperture being smaller than that of the notch. Assembly is performed in a single operation without addition of solder.

4 Claims, 3 Drawing Sheets

METHOD OF WELDING A FLEXIBLE CONDUCTOR TO A CONTACT FINGER

BACKGROUND OF THE INVENTION

The invention relates to a connection process by welding a flexible conductor, (e.g., a braided copper strip), to a rear end of a contact finger made of an electrically conductive material (e.g., copper) side by side stacking of two elementary blades of identical external profile joined together at the rear part by a common contact pad.

The document FR-A-2,556,515 describes a multiple electrical contact device for high current circuit breakers, wherein each contact finger comprises a pair of identical blades joined side by side. The rear end of each blade is provided with a notch to enable the braided strip to be fixed. This assembly is performed by a first hot mechanical insertion operation of the end of the braided strip in the two notches passing over the whole width of the finger, followed by a second soldering operation by addition of tin. A third surfacing operation is then necessary to remove the undesirable particles due to the soldering. The latter operation is performed manually by means of a cleaning brush, and must be carried out directly after soldering, when the two opposite surfaces of the connection are still hot. The opposite end of the braided strip is inserted in the notches of an input current terminal pad, then resistance welded after local deformation of the teeth forming the limits of the notches.

A first object of the invention consists of improving the assembly process of a braided strip with a contact finger.

SUMMARY OF THE INVENTION

The process according to the invention is characterized in that:

the end of the braided strip is compacted to obtain a rigid end of complementary shape to that of a semi-open notch made in the first blade, the end having a thickness slightly greater than the thickness of the first blade;

the contact finger is positioned flat on the second blade side on the fixed electrode of a welding press, the notch of the first blade and a juxtaposed flat face of the second blade defining a housing;

the end is then resistance heated and incrusted by hot compression in the housing by means of the moving electrode, the opposite edges of the contact finger having being previously blocked at the level of the connection zone, the mechanical blocking effect being exerted perpendicularly to the direction of compression and welding current flow.

Assembly by resistance welding is performed in a single operation, without addition of solder. The additional surfacing operation is no longer required, as the use of electrodes with flat bearing surfaces avoids local deformation of the blades and any material overspill in the welded connection zone.

The excess copper due to the overthickness of the compacted end of the braided strip is compensated automatically in the connection when the hot incrustation operation is performed. Reduction of the excess is achieved either by maximum crushing of the turns of the compacted end of the braided strip, or by removing the molten copper to an overspill aperture provided in the second blade.

A second object of the invention concerns achieving a contact finger with several blades and a braided connecting strip for high current circuit breakers. Welding of the braided strip is performed in a semi-housing limited by a semi-open notch of the first blade and the juxtaposed flat face of the second blade. The presence in the second blade of an overspill aperture facing the notch of the first blade enables the excess copper to be absorbed when hot incrustation of the compacted end of the braided strip is performed in the housing. The surface of the aperture is smaller than that of the notch. This results in an additional securing means which increases the strength of the welded connection.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
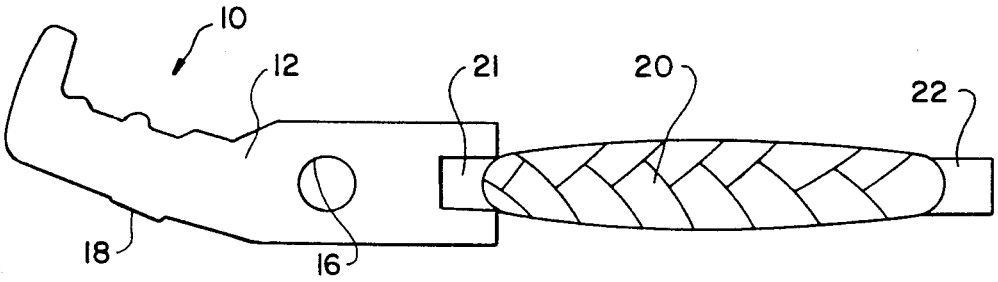
FIG. 1 is a schematic elevational view of a contact finger with double blade connected to a braided connecting strip.
Figure 2:
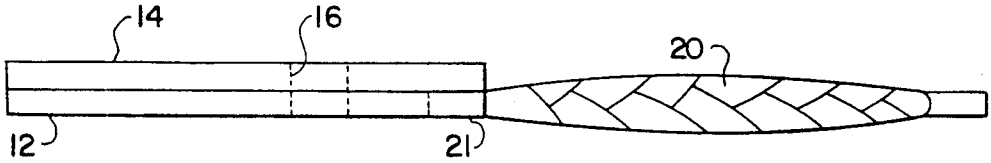
FIG. 2 shows a plane view of FIG. 1.
Figure 3:
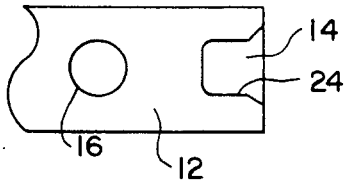
FIG. 3 represents a partial view of the rear part of the contact finger in FIG. 1, before welding of the braided strip.
Figure 4:
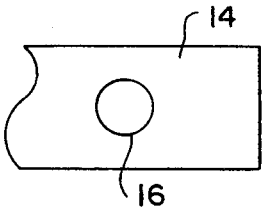
FIGS. 4 and 5 show respectively the second and first blades of the contact finger in FIG. 3.
Figure 5:
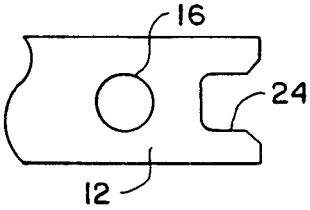

In the figures, a movable contact finger 10 of a low voltage current breaking device, notably a high current electrical circuit breaker, is formed by side by side stacking of two elementary blades 12, 14, having identical external profiles. Each blade 12,14 is cut from a copper strip, having a thickness of about two millimeters. A circular orifice 16 is arranged in each blade 12, 14 to enable the finger 10 to be mounted on a transverse pivoting spindle. Assembly of the first and second elementary blades 12, 14 is achieved by fixing a contact pad 18 to the front part, and by connecting the end 21 of a flexible braided strip 20 to the rear part of the finger 10. The other end 22 of the strip 20 is designed to be connected to a current input terminal (not shown).

The silver-based contact pad 18 is fixed to the bottom edges of the blades 12, 14 by means of a resistance soldering or welding operation, described in detail in French Patent 2,541,520.

The flexible strip 20 is made of copper, and the end 21 is shaped by a compacting and shearing operation to obtain a tin-free rigid rectangular end. This compacting operation of the strip 20 is performed by a special machine.

The rear part of the first blade 12 is equipped with a semi-open notch 24 cooperating with the juxtaposed flat part of the second blade 14 to define a housing 25 receiving the end 21 to be connected.

Figure 6:
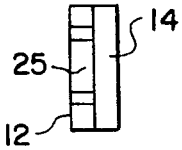
FIG. 6 is a right-hand profile view of FIG. 3.
Figure 7:
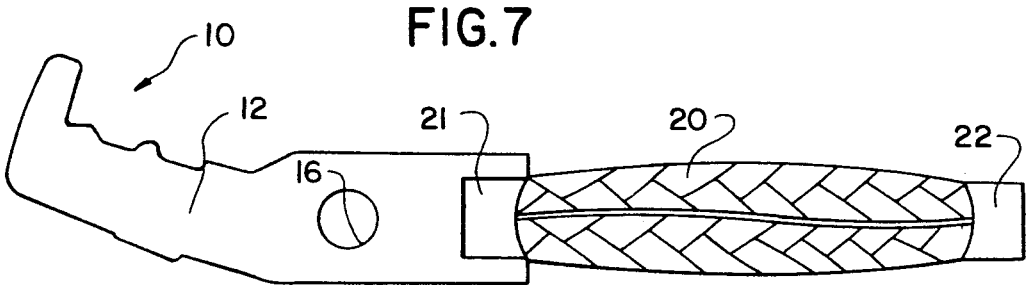
FIGS. 7 to 11 are identical respective views of FIGS. 1 to 6 of an alternative embodiment of the invention.
Figure 8:
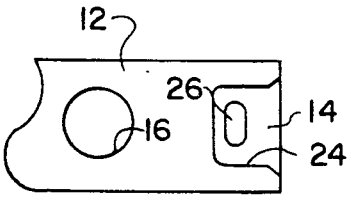
Figure 9:
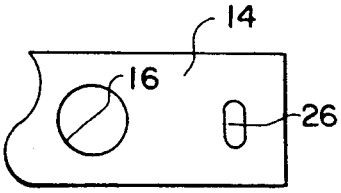
Figure 10:
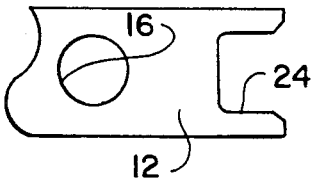
Figure 11:
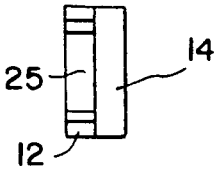

The notch 24 and end 21 have conjugate rectangular shapes, and the depth of the housing 25 corresponds appreciably to the thickness of the blade 12 (see FIGS. 6 and 11). The thickness h of the compacted end 21 of the strip 20 (see FIG. 12) is on the other hand slightly greater than the depth of the housing 25, i.e. than the thickness of the blade 12.

FIGS. 1 to 6 and 7 to 11 show two embodiments of the contact finger 10 for different circuit breaker ratings.

FIGS. 1 to 6 show a relatively low rated device, wherein the strip 20 has a reduced cross-section, and the whole rear part of the second blade 14, beyond the orifice 16, is solid.

FIGS. 7 to 11 show a relatively higher rated device, wherein the double section of the strip 20 requires a larger notch 24 in the first blade 12. In this case, an oblong overspill aperture 26 (FIGS. 8 and 9) is arranged between the rear end of the second blade 14 and the orifice 16, to improve the connection between the strip 20 and finger 10 when the welding operation is performed. The shape of this aperture 26 may be different, or comprise a plurality of holes. In the adjoining position of the two blades 12, 14 (FIG. 8), the aperture 26 of the second blade 14 is located in proximity to a plane passing through the bottom of the notch 24 of the first blade 12. The length of the aperture 26 corresponds appreciably to the width of the notch 24.

Figure 12:
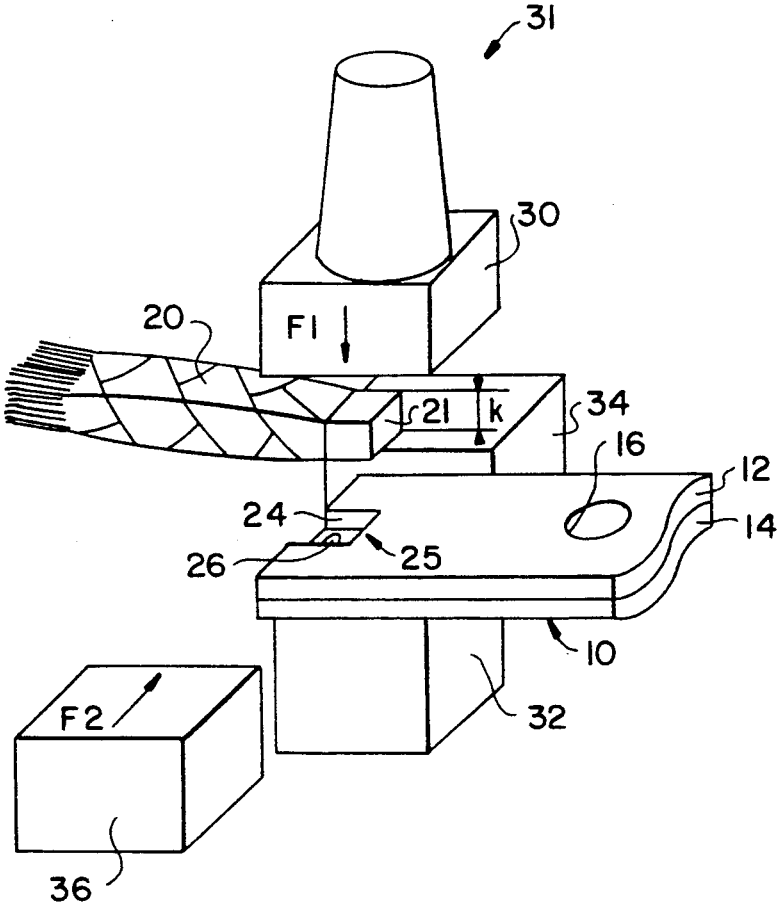
FIG. 12 schematically illustrates the welding press before the welding operation of the braided strip to the contact finger.
Figure 13:
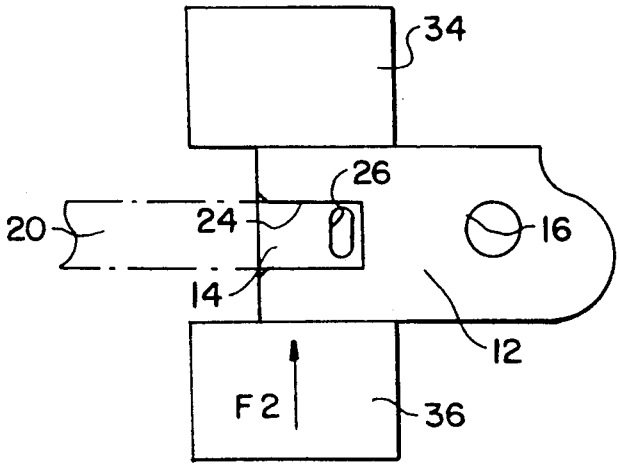
FIG. 13 is a schematic plane view of the press in FIG. 12, at the beginning of the welding phase.

Referring more particularly to FIGS. 12 and 13, which illustrate the initial phase of the welding process of the strip 20 to the contact finger 10, the compacted end 21 of the strip 20 is positioned between the moving electrode 30 of a resistance welding press 31, and the notch 24 of the first blade 12 of the finger 10. The second blade 14 of the latter bears flat on the fixed electrode 32, so that the axis of the orifices 16 extends vertically in the direction of movement of the moving electrode 30. The complementary shapes of the end 21 and notch 24 allow cold or hot incrustation respectively before and during the welding operation.

In the example in FIG. 12, the end 21 extends parallel to the blade 12 and protrudes above the notch 24. Downwards movement of the moving electrode 30 according to the arrow F1 causes progressive moving together of two clamping jaws 34, 36 of the welding press on the edges of the contact finger 10, followed by hot incrustation of the end 21 in the housing 25 by mechanical compression and electrical heating effect due to the flow of a welding current. Blocking of the contact finger 10 by the action of the clamping jaws 34, 36 on the opposite edges of the blades 12, 14 (arrow F2, FIG. 13) is performed at the rear part of the finger 10 to prevent local deformation of the blades 12, 14 during the welding operation. The blocking force F2 of the jaws 34, 36 is exerted transversely in a direction perpendicular to the movement of the moving electrode 30. Resistance welding of the braided copper strip 20 to the copper contact finger 10 is performed without addition of soldering metal (tin), and without annealing. The flat configuration of the two electrodes 30, 32 contributes to obtaining after welding smooth lateral surfaces at the connection zone level, which do not require any additional surfacing or cleaning operation of the contact finger 10.

The excess copper due to the overthickness of the compacted end 21 of the braided strip 20 is reduced automatically when hot incrustation is performed by the welding press:

either by maximum crushing of the turns of the end 21 of the compacted strip (case of FIGS. 1 to 6);

or by removing molten copper to the aperture 26 of the second juxtaposed blade 14 (case of FIGS. 7 to 11) enabling an additional gripping effect to be obtained improving the tensile strength of the welded connection.

The clamping jaws 34, 36 of the welding press are advantageously made of molybdenum, and are arranged to branch off a fraction of the current flowing in the electrodes 30, 32.

This welding process of a braided copper strip to a copper contact, without adding any soldering metal, is advantageously used for multiple contacts of poles over 1000 A.

We claim:

1. A method of joining a flexible conductor to a contact finger defined by first and second blades being joined by a common contact pad, comprising the steps of:

compacting an end of said flexible conductor to yield a rigid end which has a complementary shape to a semi-open notch in said first blade;

positioning said contact finger on a fixed electrode of a welding press such that said semi-open notch faces a movable electrode of said welding press;

positioning said rigid end between said semi-open notch and said movable contact;

resistance heating and incrusting said rigid end positioned in said semi-open notch by applying an electrical welding current and mechanical deformation force to said rigid end via said electrodes; and applying a blocking force to said contact finger via blocking means, said blocking force being applied in a direction perpendicular to a direction of said mechanical deformation force.

2. The method of claim 1, wherein an excess thickness of said rigid end is removed by said resistance heating and incrusting steps.

3. The method of claim 2, wherein said mechanical deformation force removes said excess thickness by compressing said rigid end.

4. The method of claim 2, wherein molten material from said rigid end is accommodated in an aperture in said second blade thereby removing said excess thickness.

* * * * *